US011527369B2

(12) United States Patent
Knol et al.

(10) Patent No.: US 11,527,369 B2
(45) Date of Patent: Dec. 13, 2022

(54) CHANGEOVER SWITCH

(71) Applicant: Eaton Intelligent Power Limited, Dublin (IE)

(72) Inventors: Bert Knol, Hengelo (NL); Dinant Heilersig, Markelo (NL); Akshay Bankar, Hengelo (NL); Paul Geusendam, Hengelo (NL)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/530,499

(22) Filed: Nov. 19, 2021

(65) Prior Publication Data

US 2022/0165513 A1 May 26, 2022

(30) Foreign Application Priority Data

Nov. 20, 2020 (GB) ..... 2018258

(51) Int. Cl.
*H01H 9/02* (2006.01)
*H01H 3/38* (2006.01)

(52) U.S. Cl.
CPC ..... *H01H 9/02* (2013.01); *H01H 3/38* (2013.01); *H01H 2235/01* (2013.01)

(58) Field of Classification Search
CPC ..... H01H 9/02; H01H 3/38; H01H 2235/01; F16F 1/32
USPC ..... 200/52 R
See application file for complete search history.

(56) References Cited

FOREIGN PATENT DOCUMENTS

| | | | | |
|---|---|---|---|---|
| CN | 102290263 A | | 12/2011 | |
| EP | 0951030 | * | 10/1999 | ..... H01H 1/42 |
| JP | S6192330 | * | 5/1986 | ..... F16F 3/02 |
| JP | S 6192330 A | | 5/1986 | |
| JP | H 09326221 A | | 12/1997 | |
| WO | WO 2011082528 A1 | | 7/2011 | |

* cited by examiner

*Primary Examiner* — Edwin A. Leon
*Assistant Examiner* — Iman Malakooti
(74) *Attorney, Agent, or Firm* — Leydig, Voit & Mayer, Ltd.

(57) ABSTRACT

A changeover switch for medium voltage switchgear is provided. The changeover switch includes a first terminal body, a second terminal body, and two elongate pole bodies. The two elongate pole bodies are arranged parallel to each other and rotatably arranged with first ends on opposite sides of, and in direct contact with the first terminal body around a rotation axis. The two elongate pole bodies are rotatable between an open position and a closed position. The second ends of the two elongate pole bodies are positioned in direct contact with opposite sides of the second terminal body. The changeover switch further includes one or more springs arranged between the two elongate pole bodies to urge the two elongate pole bodies towards each other.

7 Claims, 2 Drawing Sheets

CHANGEOVER SWITCH

CROSS-REFERENCE TO PRIOR APPLICATION

Priority is claimed to British Patent Application No. GB 2018258.0, filed on Nov. 20, 2020, the entire disclosure of which is hereby incorporated by reference herein.

FIELD

The invention relates to a changeover switch for medium voltage switchgear.

BACKGROUND

Changeover switches are used to accomplish an insulating distance in the circuit, after the current is interrupted with the circuit breaker or load break switch. This changeover switch is designed for a specific rated current. The current and resistance in the circuit are highly determining the temperature rise in the circuit. To prevent the temperature rise from becoming too high during rated current flow, it is important that the total resistance of the changeover switch will be low, also after a specified number of switching operations.

Furthermore, changeover switches need to be reliable for a number of opening and closing operations. The wear should be minimized, as wear will increase the ohmic-resistance.

SUMMARY

In an embodiment, the present invention provides a changeover switch for medium voltage switchgear, wherein the changeover switch comprises: a first terminal body; a second terminal body; two elongate pole bodies arranged parallel to each other and rotatably arranged with first ends on opposite sides of, and in direct contact with the first terminal body around a rotation axis, wherein the two elongate pole bodies are rotatable between an open position and a closed position, wherein second ends of the two elongate pole bodies are positioned in direct contact with opposite sides of the second terminal body; and one or more springs arranged between the two elongate pole bodies to urge the two elongate pole bodies towards each other.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
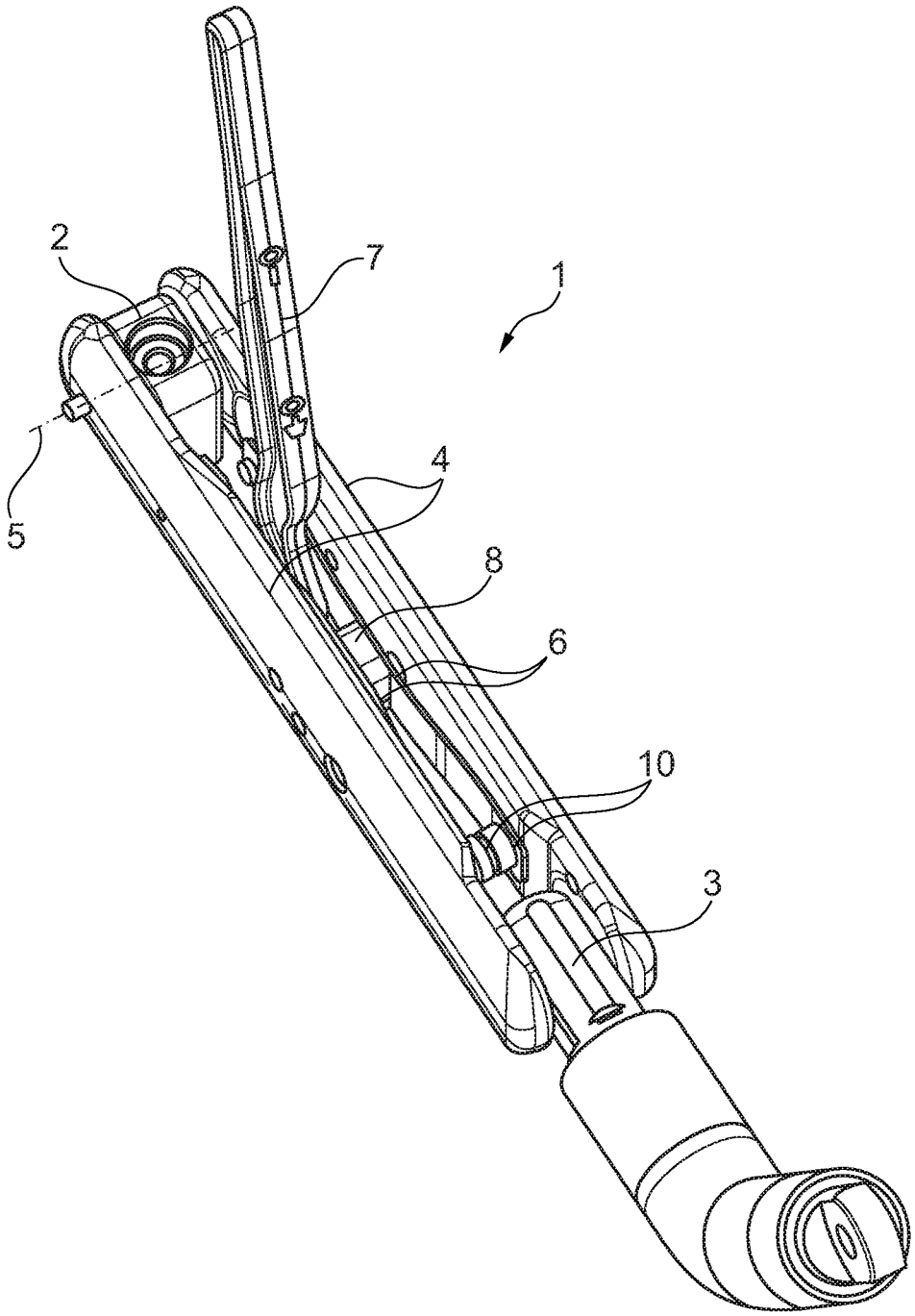
FIG. 1 shows a perspective view of an embodiment of a changeover switch according to the invention in closed position.

In an embodiment, the present invention provides a changeover switch in which the above mentioned disadvantages are reduced or even prevented.

In an embodiment, a changeover switch is provided. The changeover switch comprises:

a first terminal body a second terminal body two elongate pole bodies arranged parallel to each other and rotatable arranged with first ends on opposite sides of, and in direct contact with the first terminal body around a rotation axis, wherein the two elongate pole bodies are rotatable between an open position and a closed position, wherein the second ends of the two elongate pole bodies are positioned in direct contact with opposite sides of the second terminal body; and one or more springs arranged between the two elongate pole bodies to urge the pole bodies towards each other.

With the changeover switch according to the invention, the one or more springs urge the two elongate pole bodies in direct contact with the first and second terminal body. Even if any wear would occur, the one or more springs will maintain this direct contact. Furthermore, the spring force of the one or more springs also ensure a sufficient contact force, which will minimize ohmic-resistance and therefore undesired heat generation.

In a preferred embodiment of the changeover switch according to the invention, the spring means comprise at least one leaf spring connected with a center part to one of the two elongate pole bodies and connected with both ends to the other of the two elongate pole bodies.

A leaf spring is elongate and generates a relative high spring force upon a relative small deformation in a direction perpendicular to the length of the leaf spring. Due to its shape, a leaf spring can thus easily be housed between the two elongate pole bodies, while ensuring sufficient force to urge the elongate pole bodies towards each other.

In a further preferred embodiment of the changeover switch according to the invention, the one or more springs comprise two leaf springs, which leaf springs are connected with one of the center parts or the ends to each other and with the other of the center parts or the ends to each of the elongate pole bodies respectively.

By using two leaf springs the configuration of the changeover switch can be made line symmetrical over the longitudinal direction of the changeover switch, i.e. between the first and second terminal body.

In a further embodiment of the changeover switch according to the invention, at least one spacer is arranged between the two leaf springs in order to adjust the pretension of the leaf springs.

The spacer allows to set the pretension of the leaf springs. A thicker spacer will reduce the pretension, while a thinner spacer will increase the pretension.

It is further preferred if the ends of the at least one leaf spring are provided with slot shaped opening and wherein a bolt extends through the slot shaped openings for mounting the ends.

When the leaf springs are deformed, the length of the leaf spring will change slightly. By using slot shaped openings, this change in length can be taken up, while the ends are still connected.

Yet another embodiment of the changeover switch according to the invention further comprises an operating rod arranged hingedly with one end to at least one of the elongate pole bodies at a distance from the first ends.

With the operating rod, the changeover switch can be rotated between the open position and the closed position.

In FIG. 1 a changeover switch 1 is shown. The changeover switch 1 has a first terminal body 2 and a second terminal body 3. Two elongate pole bodies 4 are arranged with a first end on opposite sides of the first terminal body 2. The elongate pole bodies 4 can rotate around a rotation axis 5 relative to the first terminal body 2.

As shown, closed position of the changeover switch 1, the elongate pole bodies 4 are positioned with the second ends in direct contact with opposite sides of the second terminal body 3.

To achieve a sufficient contact force of the elongate pole bodies 4 onto the first terminal body 2 and the second terminal body 3, two leaf springs 6 are arranged between the elongate pole bodies 4.

Figure 2:
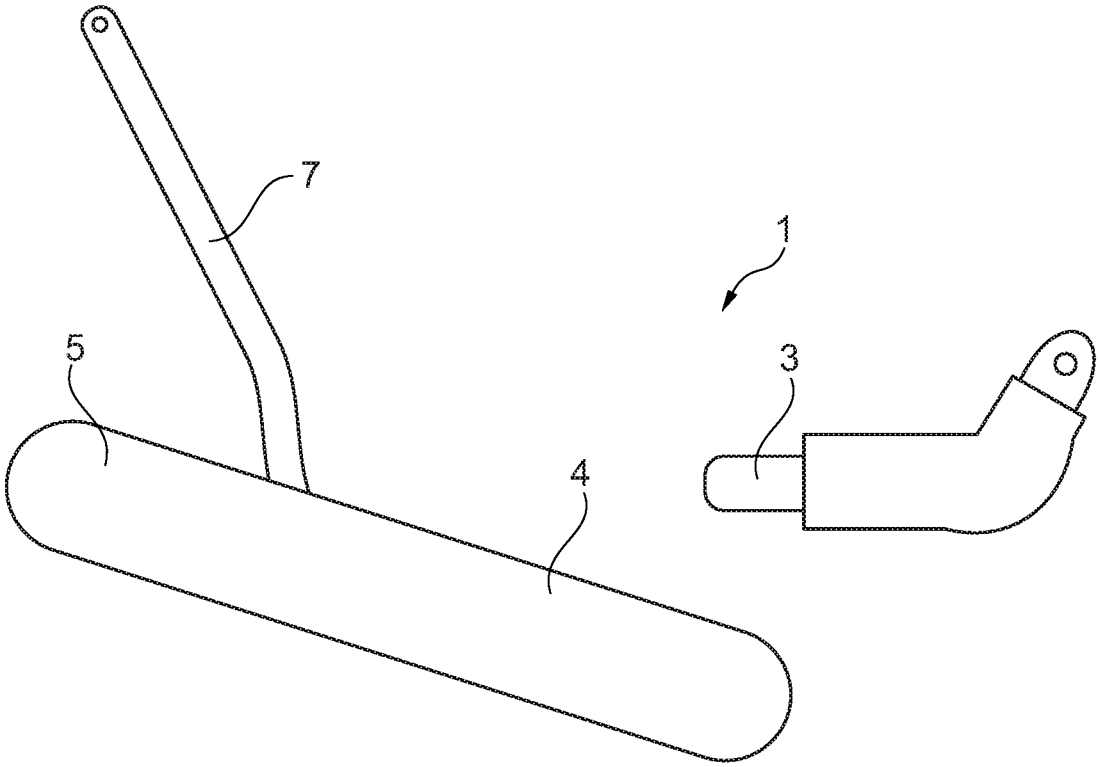
FIG. 2 shows the changeover switch of FIG. 1 in side view and in open position.

An operating rod 7 is arranged hingedly with one end to the elongate pole bodies 4, such that the elongate pole bodies 4 can be rotated between the closed position, as shown in FIG. 1, and the open position, as shown in FIG. 2.

Figure 3:
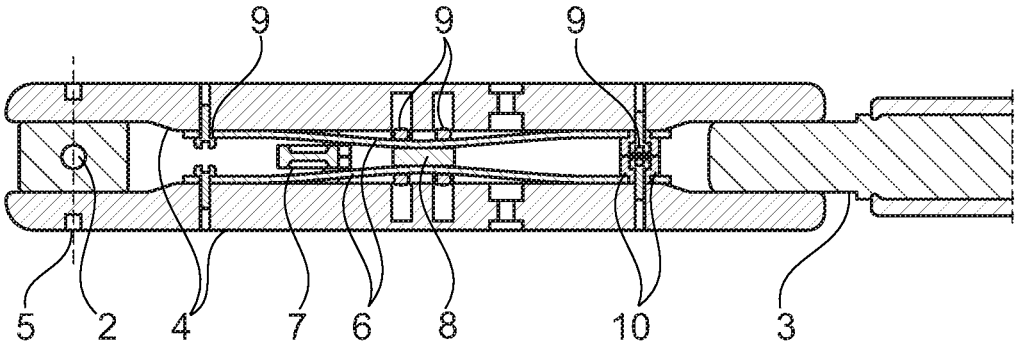
FIG. 3 shows a cross-sectional view of FIG. 1.

As shown in FIG. 3, the leaf springs 4 are arranged with a center part to a spacer 8 and with the ends arranged to the respective elongate pole bodies 4 by bolts 9.

On end of each leaf spring 6 is provided with a slot shaped opening through which a bushing 10 extends, which allows the leaf spring 6 to shift relative to the elongate pole bodies 4.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A changeover switch for medium voltage switchgear, wherein the changeover switch comprises:

a first terminal body;

a second terminal body;

two elongate pole bodies arranged parallel to each other and rotatably arranged with first ends on opposite sides of, and in direct contact with the first terminal body around a rotation axis, wherein the two elongate pole bodies are rotatable between an open position and a closed position, wherein second ends of the two elongate pole bodies are positioned in direct contact with opposite sides of the second terminal body; and one or more springs arranged in a cavity that is formed between the two elongate pole bodies to urge the two elongate pole bodies towards each other, wherein the one or more springs comprise at least a portion that is substantially parallel to the two elongated pole bodies.

2. The changeover switch according to claim 1, wherein the one or more springs comprise at least one leaf spring connected with a center part to one of the two elongate pole bodies and connected with both ends to the other of the two elongate pole bodies.

3. The changeover switch according to claim 2, wherein the one or more springs comprise two leaf springs, wherein the two leaf springs are connected with one of the center parts or the ends to each other and with the other of the center parts or the ends to each of the two elongate pole bodies respectively.

4. The changeover switch according to claim 3, wherein at least one spacer is arranged between the two leaf springs in order to adjust the pretension of the two leaf springs.

5. The changeover switch according to claim 2, wherein the ends of the at least one leaf spring are provided with a slot shaped opening, and wherein a bolt extends through the slot shaped openings for mounting the ends.

6. The changeover switch according to claim 1, further comprising an operating rod arranged hingedly with one end to at least one of the elongate pole bodies at a distance from the first ends.

7. The changeover switch according to claim 2, wherein the at least one leaf spring comprises a second portion that is in a concave shape.

* * * * *